US011090520B2

(12) United States Patent
Bell et al.

(10) Patent No.: US 11,090,520 B2
(45) Date of Patent: Aug. 17, 2021

(54) COMPOSITION AND METHOD FOR DECONTAMINATING OPIOIDS ON SURFACES

(71) Applicant: TDA Research, Inc, Wheat Ridge, CO (US)

(72) Inventors: William Bell, Boulder, CO (US); Christopher Brian France, Arvada, CO (US)

(73) Assignee: TDA Research, Inc., Wheat Ridge, CO (US)

( * ) Notice: Subject to any disclaimer, the term of this patent is extended or adjusted under 35 U.S.C. 154(b) by 972 days.

(21) Appl. No.: 15/789,777

(22) Filed: Oct. 20, 2017

(65) Prior Publication Data

US 2019/0118018 A1 Apr. 25, 2019

(51) Int. Cl.

| | |
|---|---|
| ***A62D 3/38*** | (2007.01) |
| ***C11D 7/50*** | (2006.01) |
| ***C11D 7/04*** | (2006.01) |
| ***C11D 3/39*** | (2006.01) |
| ***A62D 3/13*** | (2007.01) |
| ***C11D 1/825*** | (2006.01) |
| ***C11D 3/395*** | (2006.01) |
| *A62D 101/26* | (2007.01) |
| *C11D 1/75* | (2006.01) |
| *C11D 1/72* | (2006.01) |
| *C11D 1/74* | (2006.01) |

(52) U.S. Cl.

CPC ..... *A62D 3/38* (2013.01); *A62D 3/13* (2013.01); *C11D 1/825* (2013.01); *C11D 3/3945* (2013.01); *C11D 3/3953* (2013.01); *C11D 3/3955* (2013.01); *C11D 7/04* (2013.01); *C11D 7/5013* (2013.01); *A62D 2101/26* (2013.01); *A62D 2203/04* (2013.01); *C11D 1/72* (2013.01); *C11D 1/74* (2013.01); *C11D 1/75* (2013.01)

(58) Field of Classification Search

CPC ..... A62D 3/38; A62D 2101/26; C11D 7/04; C11D 7/5013

USPC ..... 588/320

See application file for complete search history.

(56) References Cited

U.S. PATENT DOCUMENTS

2009/0131732 A1* 5/2009 Day ..... A62D 3/36 588/249.5

2015/0265867 A1* 9/2015 Sarangapani ..... B65D 81/02 588/320

* cited by examiner

*Primary Examiner* — Edward M Johnson

(74) *Attorney, Agent, or Firm* — Brian J. Elliott

(57) ABSTRACT

A composition that can decontaminate opioids on surfaces or objects, and in particular decontaminate fentanyls on surfaces using an opioid-active reagent and an opioid-effective solubilizing agent, which is a mixture of an alkyl dimethylamine oxide surfactant, an alkyl dimethylamine oxide surfactant, a $C_{8-18}$ alkyl polyethylene glycol sorbitan fatty ester surfactant, and a $C_{12-14}$ secondary alcohol ethoxylate surfactant. Preferably, the opioid-active reagent is chlorine dioxide. Additionally, methods for decontaminating opioids on surfaces using this composition.

12 Claims, No Drawings

COMPOSITION AND METHOD FOR DECONTAMINATING OPIOIDS ON SURFACES

FIELD OF THE INVENTION

The field of the invention relates to a method of decontaminating opioids on surfaces or on objects, including fentanyl and other opioids.

BACKGROUND

Opioids are drugs that are widely available, both legal and illegal, and have been responsible for thousands of fatalities from overdoses. Some opioids are highly toxic, and exposure by inhalation or skin contact may cause unconsciousness and even death. When an opioid is encountered in an unregulated environment (for example, as an illegal street drug), it may be necessary to decontaminate the material rapidly where it is encountered to minimize the hazard to personnel dealing with the situation and to others in the area. In particular, the increasing presence of fentanyl and its analogs, which are more toxic than many other opioids, make it essential to develop effective methods for decontamination of opioids.

Common cleaners or reactive materials are often ineffective in rendering an opioid contaminated surface safe, because they either cannot solubilize the opioids, or they cannot decontaminate the opioids, or they suffer from a combination of both.

The decontamination methods and materials of the prior art suffer from at least one of the following limitations: they cannot react with the opioid to produce a lower toxicity, or non-toxic product, they cannot solubilize the solid opioid contamination and release it from a surface, they cannot promote the release of the opioid from a surface and subsequent decontamination by reaction in solution, they cannot remove enough of the opioid from the surface to render it safe, and most significantly, they cannot decontaminate solid opioids on surfaces (in the solid state).

BRIEF SUMMARY OF THE INVENTION

The present invention solves the limitations of the prior art and provides a composition and a method of using the composition to decontaminate surfaces or objects that have opioid contamination. The invention provides materials and procedures that can be used to prevent accidental overdose by surface contact and also to save human life and make it easier to clear contaminated areas for persons including law enforcement or first responders to operate in an area that has opioid or potential opioid contamination.

The present invention provides a composition for decontaminating opioids comprising an opioid-active reagent, optionally further comprising an opioid-effective solubilizing agent. The opioid-active reagent has a chemical reactivity such that the opioid-active reagent converts a fentanyl into an opioid reaction product; wherein the fentanyl has a chemical structure given in scheme 4 (below), wherein, $R_1$ is selected from the group consisting of an alkyl group and an aromatic group, $R_2$ is selected from the group consisting of hydrogen, an alkyl group, an alkoxide, an ester, and an aromatic group and $R_3$ is selected from the group consisting of an alkyl amino group an amino aromatic group, a multi-functionalized amino group and an amino alkoxide group. In optional embodiments, the opioid-active reagent is selected from the group consisting of chlorine dioxide, a peroxide, an organic peroxide, a peracetic acid, trichloroisocyanuric acid and sodium dichloroisocyanurate. Preferably, the opioid-active reagent is chlorine dioxide. Alternatively, the opioid-active reagent is preferably a chlorine dioxide precursor, more preferably wherein the chlorine dioxide precursor is sodium chlorite.

In optional embodiments, the composition further comprises an acidic pH modifier.

In further embodiments, the composition has a chlorine dioxide precursor that is sodium chlorite, and wherein the composition further comprises an organic photoactivator to promote conversion of sodium chlorite to chlorine dioxide.

In an optional embodiment the opioid-effective solubilizing agent is SSDX-12™, defined in detail below in the Detailed Description of the Invention.

The present invention also provides a method of decontaminating opioids, the method comprising the step of applying the compositions (above) to a surface or an object contaminated with an opioid; and, using the composition to chemically convert the opioid into an opioid reaction product. In optional embodiments, the method further comprises the step of providing mechanical energy to the composition in contact with the opioid to enhance mixing between the composition and the opioid. Preferably, the mechanical energy is either stirring, spraying, power washing, brushing, ultrasonic energy, or combinations thereof. The cleaning method may further comprise an opioid-effective solubilizing agent.

The method optionally provides the use of a composition wherein the opioid-active reagent has a chemical reactivity such that the opioid-active reagent converts a fentanyl into an opioid reaction product. Preferably, the opioid-active reagent is selected from the group consisting of chlorine dioxide, a peroxide, an organic peroxide, a peracetic acid, trichloroisocyanuric acid and sodium dichloroisocyanurate. More preferably, the opioid-active reagent is chlorine dioxide. Alternatively, the composition also comprises a chlorine dioxide precursor, and the chlorine dioxide precursor is more preferably sodium chlorite. Alternatively, the composition may comprise an acid that promotes conversion of sodium chlorite to chlorine dioxide. Further still, the method may use a composition that has an organic photoactivator to promote conversion of sodium chlorite to chlorine dioxide and may include the step of exposing the composition to light to photogenerate chlorine dioxide. Further still, the method may use photochemical conversion of sodium chlorite to chlorine dioxide and exposing the composition to light will generate chlorine dioxide.

DETAILED DESCRIPTION OF THE INVENTION

Opioids are understood to be all substances that act on opioid receptors to produce morphine-like effects. Opioids may include natural opiates (alkaloids contained in the resin of the opium poppy, primarily morphine, codeine and thebaine), esters of morphine (slightly chemically modified morphine, for example morphine diacetate), semi-synthetic opioids (hydromorphone, hydrocodone, oxycodone, oxymorphone, ethylmorphine), and fully synthetic opioids (fentanyl, pethidine, levorphanol, methadone, tramadol, tapentadol and detropropoxyphene).

Scheme 1. Structure of morphine, one example of a prototypical natural opiate.

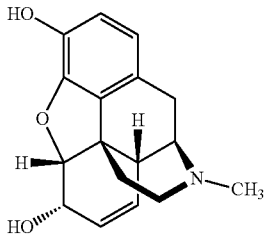

Scheme 2. Structure of morphine, diacetate, heroin, one example of an ester of morphine.

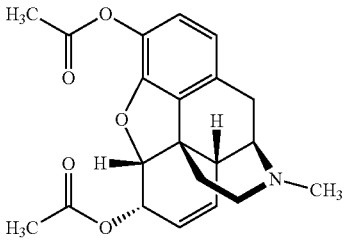

Scheme 3. Structure of oxycodone, one example of a semi-synthetic opiod.

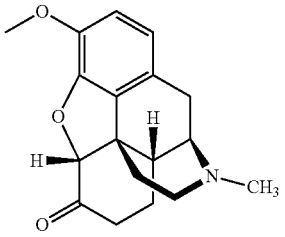

Fentanyls are a class of opioids that generally have an N-alkylpiperidine group in the chemical substructure as shown in Scheme 4, wherein $R_1$ is selected from the group consisting of an alkyl group and an aromatic group, $R_2$ is selected from the group consisting of hydrogen, an alkyl group, an alkoxide, an ester, and an aromatic group and $R_3$ is selected from the group consisting of an alkyl amino group an amino aromatic group, a multi-functionalized amino group and an amino alkoxide group.

Scheme 4. The N-alkylpiperidine structure group found in Fentanyls.

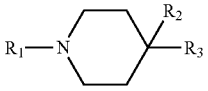

"Fentanyls" means fentanyl and its analogs, including but not limited to mefentanyl, phenaridine, ohmefentanyl, carfentanil, lofentanil, sufentanil, alfentanil, brifentanil, remifentanll, trefentanil, and mirfentanil.

Scheme 5.
Chemical structure of fentanyl, a prototypical example of a fully synthetic opioid.

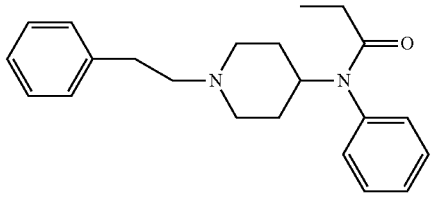

Scheme 6.
Chemical structure of carfentanil (also called carfentanyl), an example of an opioid in the fantanyls family.

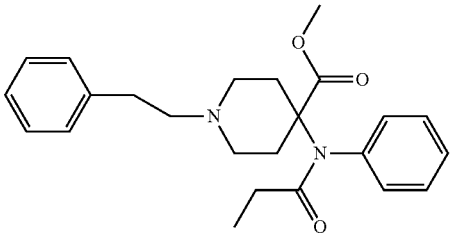

The term "decontaminate" means to treat a material or surface to mitigate the hazard presented by the material, or by the materials present on a surface. Decontaminate can mean cleaning a surface to remove the contamination, treating the material or surface with a reactant to chemically alter the hazardous material to reduce its hazard to people, or a combination of both (for example where the opioid is released from the surface into an aqueous solution and then it chemically reacts with an opioid-active reagent). Decontaminate includes removing and chemical alteration either individually or in combination. The combination may involve cleaning and chemical alteration in separate steps, or use of a formulation that both cleans and chemically alters the opioid.

The term "opioid-effective solubilizing agent" means a surfactant or detergent suitable for removing opioids from surfaces, wherein the opioids have a limited intrinsic water solubility, and are difficult to remove from a surface. Additional desirable features of an opioid-effective solubilizing agent are the ability to retain the opioid in water as an emulsion and prevent redeposition of the opioid on the surface or on other surfaces.

Non-limiting examples of opioid-effective solubilizing agents include Dawn® and SSDX-12™ (a technical description of SSDX-12™ can be found in U.S. Pat. No. 9,295,865, "SURFACTANT COMPOSITION AND METHOD FOR DECONTAMINATION", which is incorporated by reference herein. SSDX-12™ can be used with and without the corrosion inhibitor described in U.S. Pat. No. 9,295,865. SSDX-12™ is a brand of surface cleaner owned by TDA Research, Inc. and Dawn® is a brand of dishwashing liquid owned by Procter & Gamble.

A composition for decontaminating opioids may contain both an opioid-effective solubilizing agent and also optionally a compound to adjust the pH of the solution to increase the water solubility of the opioid (by protonating the free base form of the opioid: the charged, protonated form is more soluble in water). For example, protonating a neutral (not charged) amine group on the opioid to make a quaternary ammonium salt may increase the water solubility of the opioid. The quaternary ammonium salt may optionally have an organic anion, such as citrate. Increased water solubility improves removal from surfaces, but it also improves the chemical interaction between the opioid and a water-soluble opioid-active reagent, which can increase the rate of reaction for decontamination.

Compounds used to adjust the pH of the solution may include mineral acids (sulfuric acid, hydrochloric acid), organic acids (lactic acid, acetic acid, levulinic acid, stearic acid, etc.) and pH buffer solutions. The term "acidic pH modifier" means one or more of the above compounds used to lower the pH of the solution.

Use of a decontaminating composition may be desirable with unknown or poorly characterized materials. These materials may have limited water solubility, and the opioid-effective solubilizing agent will help to suspend the material and improve its contact with the opioid-active reagent.

Particularly with fentanyls, there is limited data on their reactivity with potential decontaminants on surfaces, and most of the available data is based on tests with the fentanyl as a water solution. In contrast, in certain embodiments of the present invention, it is an objective to provide a decontaminating composition and a method (using the composition) to decontaminate opioids that are present in solid form, either in bulk solid or powder, or as solids spread on a surface, without first dissolving the opioid in water (i.e. to decontaminate the solid opioids, in situ). This can be critical in situations where speed is of the essence or when it is undesirable to potentially generate a new, liquid waste stream that must be dealt with after the surface cleaning because it may now be classified as a hazardous material (or a material that could be hazardous until tested and proven otherwise).

Without wishing to be bound by theory, the general goal of fentanyl decontamination is to chemically break as least one C—N bond in the core N-alkylpiperidine structure group found in fentanyls (see Scheme 4), or in the tertiary amine found in the group R3 in Scheme 4 (i.e. fentanyl, see scheme 5). Preferred oxidants including chlorine dioxide are effective at promoting such fragmentation, or oxidative C—N bond breaking. Fentanyl reaction products (after exposure to opioid-effective reactants that are oxidizers) include phenethylene (also called styrene), benzaldehyde, denzenemethanol, benzeneacetaldehyde, N-phenylpropanamide, N-phenyl-N-(4-piperodinyl)propanamide, and N-(1-formylpiperidine-4-yl)-N-phenylpropionamide. Secondary oxidative chemical reactions are also possible that lead to additional fragments and rearrangement compounds (for example the formation of bezaldhyde, benzenemethanol and benzeneacetaldehyde). The fentanyl fragments from a single oxidative C—N bond breaking include phenethylene (styrene), N-phenylpropanamide, N-phenyl-N-(4-piperodinyl) propanamide, and N-(1-formylpiperidine-4-yl)-N-phenylpropionamid.

The term "opioid-active reagent" means a material that will react rapidly with the opioid to convert it into a less hazardous material. The reaction preferably occurs in less than one hour at room temperature, more preferably in less than 15 minutes, still more preferably in less than 5 minutes, still more preferably in less than 1 minute.

The term "opioid reaction product" means a chemical compound that previously was an opioid, as defined herein, but has been modified by a chemical reaction. The opioid reaction product is ether a chemical fragment of the opioid, or a chemical adduct of the opioid. The opioid reaction product is less toxic or less hazardous than the starting opioid compound. In certain embodiments, the opioid reaction product is non-toxic or non-hazardous. In other embodiments, the opioid reaction product is a compound that is not a controlled substance as defined by the U.S. Controlled Substances Act; that is, the opioid reaction product is not listed on Schedule I, II, III, IV or V of the Controlled Substances Act. The opioid reaction product is not to be interpreted as simply the protonated or quaternized version of an opioid free base (ternary amine group). For example the opioid reaction product is not simply the citrate salt of an opioid.

Examples of opioid-active reagents include chlorine dioxide ($ClO_2$), sodium hypochlorite, hydrogen peroxide, peroxy acids, including but not limited to peracetic acid, trichloroisocyanuric acid, sodium dichloroisocyanurate, as well as ozone. In regard to chlorine dioxide, as a preferred embodiment, the chlorine dioxide may be generated by (a) acidification of chlorite ion (for example with an organic acid such as citric acid), (b) electrochemical oxidation of sodium chlorite (for example, US 2008/0241276A1, Portable Biochemical Decontamination System and Method of Using the Same, which is incorporated by reference herein) and (c) photochemical oxidation of sodium chlorite (For example, US 2015/0210963, Systems and Methods for Treating a Surface, which is incorporated by reference herein), and other methods known in the art, including those that generate chlorine dioxide using chlorine gas. Methods a, b and c are preferable to those that generate chlorine dioxide from chlorine gas because they do not require handling a pressurized cylinder of a toxic gas to prepare the composition.

The term "organic photoactivator" means a compound used to promote conversion of sodium chlorite to chlorine dioxide in the presence of light. Examples include: erythrosine eosin, riboflavin, and others identified in US 2015/0210964, which is incorporated by reference herein.

SSDX-12™ is a non-corroding cleaning composition originally developed for cleaning exterior surfaces of a vehicle. The cleaning compositions include an alkyl dimethylamine oxide surfactant, an alkyl dimethylamine oxide surfactant, a $C_{8-18}$ alkyl polyethylene glycol sorbitan fatty ester surfactant, a $C_{12-14}$ secondary alcohol ethoxylate surfactant, a sodium nitrite corrosion inhibitor, and sodium metasilicate.

Electrochemically generated chlorine dioxide is made on demand by a voltage-applying cell and a solution containing, for example, sodium chlorite. By generating the chlorine dioxide gas as needed, there is no need to transport corrosive or reactive chemicals (i.e. bleach of chlorine dioxide), and this dramatically simplifies the logistics of producing an aqueous solution of chlorine dioxide where it is needed.

Photogenerated chlorine dioxide is produced by a composition comprising a water-soluble photo activator and a chlorine dioxide precursor, such as sodium chlorite. The composition is applied in the presence of light, and chlorine dioxide is generated in situ.

Example 1. (Decontaminating a surface with an opioid-effective solubilizing agent). To a quantity of opioid on a surface, add a volume of a decontaminating composition containing an opioid-effective solubilizing agent in water equal to 100 times the volume of the opioid. The concentration of the opioid-effective solubilizing agent in water should be selected to contain a weight of the opioid-effective solubilizing agent at least 5 times the weight of the opioid. Allow up to 1 hour of contact between the composition and the opioid, with mechanical stirring or mixing to increase physical contact. After that time remove the mixture of opioid and composition from the surface, rinsing twice, each time with a volume of pure water equal to the original volume. Analysis (GC-MS) will then show that at least 90% of the opioid originally present has been removed from the surface.

Example 2. (Decontaminating a surface with an opioid-active reagent) To a quantity of opioid, add a volume of an aqueous composition equal to 100 times the volume of the opioid. The concentration of an opioid-active reagent in the water composition should be selected to contain a weight of the opioid-active reagent at least 10 times the weight of the opioid. Allow 1 hour of contact between the opioid-active reagent mixture and the opioid, with mechanical stirring or mixing to encourage contact. After that time, GC-MS analysis will show that a large majority of the opioid present has been neutralized or destroyed; that is, at least 90% of the original opioid is no longer present Example 3. (Decontaminating a surface with a composition having both an opioid-active reagent and an opioid-effective solubilizing agent) In this preferred method, the opioid-active reagent is more effective when used in combination with opioid-effective solubilizing agent. To a quantity of opioid on a surface, add a volume of an aqueous composition, having both an opioid-active reagent and an opioid-effective solubilizing agent in water, equal to 100 times the volume of the opioid. The concentration of the opioid-active reagent and an opioid-effective solubilizing agent should be selected to contain a weight of the opioid-effective solubilizing agent at least 5 times the weight of the opioid and a weight of the opioid-active reagent at least 10 times the weight of the opioid. Allow 1 hour of contact between the composition and the opioid, with mechanical stirring or mixing to encourage contact. After that time remove the composition from the surface, rinsing twice, each time with a volume of pure water equal to the original volume. After that time, analysis will show that at least 95% of the opioid originally present on the surface is no longer there, and that at least 90% of the originally present opioid has been neutralized or destroyed; that is, at least 90% of the original opioid is no longer present in either the rinsed-off composition or still on the surface.

Example 4. (Decontaminating a surface with a composition having acid-generated chlorine dioxide as the opioid-active reagent and SSDX™ as the opioid-effective solubilizing agent) In this method, the opioid-active reagent is more effective when used in combination with opioid-effective solubilizing agent. To a quantity of opioid on a surface, add a volume of an aqueous composition, having both an opioid-active reagent and an opioid-effective solubilizing agent in water, equal to 100 times the volume of the opioid. The concentration of the opioid-active reagent and an opioid-effective solubilizing agent should be selected to contain a weight of the opioid-effective solubilizing agent at least 5 times the weight of the opioid and a weight of the opioid-active reagent at least 10 times the weight of the opioid. In this example the opioid-active reagent is chlorine dioxide produced by the combination of sodium chlorite and acetic acid as precursors to the chlorine dioxide gas, which is produced in situ during the decontamination step. (For every 1 liter of water, 40 grams of sodium chlorite and 40 grams of acetic acid, and for every 1 liter of water, 15 grams of SSDX-12™). Allow 1 hour of contact between the composition and the opioid, with mechanical stirring or mixing to encourage contact. After that time remove the composition from the surface, rinsing twice, each time with a volume of pure water equal to the original volume. After that time, analysis will show that at least 95% of the opioid originally present on the surface is no longer there, and that at least 90% of the originally present opioid has been neutralized or destroyed; that is, at least 90% of the original opioid is no longer present in either the rinsed-off composition or still on the surface.

Example 5. (Decontaminating a surface with a composition having photo-generated chlorine dioxide as the opioid-active reagent and SSDX-12™ as the opioid-effective solubilizing agent) In this method, the opioid-active reagent is more effective when used in combination with opioid-effective solubilizing agent. To a quantity of opioid on a surface, add a volume of an aqueous composition, having both an opioid-active reagent and an opioid-effective solubilizing agent in water, equal to 100 times the volume of the opioid. The concentration of the opioid-active reagent and an opioid-effective solubilizing agent should be selected to contain a weight of the opioid-effective solubilizing agent at least 5 times the weight of the opioid and a weight of the opioid-active reagent at least 10 times the weight of the opioid. In this example the opioid-active reagent is chlorine dioxide produced by the combination of sodium chlorite and acetic acid as precursors to the chlorine dioxide gas, which is produced in situ during the decontamination step. (For every 1 liter of water, 10 grams of sodium chlorite and 0.01 grams of photoactivator, and for every 1 liter of water, 15 grams of SSDX-12™,) Allow 30 minutes of contact between the composition and the opioid under direct light irradiation from either sunlight or artificial lights, with mechanical stirring or mixing to encourage contact. After that time remove the composition from the surface, rinsing twice, each time with a volume of pure water equal to the original volume. After that time, analysis will show that at least 95% of the opioid originally present on the surface is no longer there, and that at least 90% of the originally present opioid has been neutralized or destroyed; that is, at least 90% of the original opioid is no longer present in either the rinsed-off composition or still on the surface.

Example 6. (Decontaminate a surface using an opioid-effective solubilizing agent and an opioid-active reagent in separate steps; opioid-effective solubilizing agent first) To a quantity of opioid on a surface, add a volume of the opioid-effective solubilizing agent in water equal to 100 times the volume of the opioid. The concentration of the opioid-effective solubilizing agent in water should be selected to contain a weight of the opioid-effective solubilizing agent at least 5 times the weight of the opioid. Allow 1 hour of contact between the opioid-effective solubilizing agent mixture and the opioid, with mechanical stirring or mixing to encourage contact. Then add a volume of the opioid-active reagent in water equal to 100 times the volume of the opioid. The concentration of the opioid-active reagent in water should be selected to contain a weight of the opioid-active reagent at least 10 times the weight of the opioid. Allow 1 hour of contact between the opioid-active reagent mixture and the opioid, with mechanical stirring or mixing to encourage contact. After that time remove the mixture of opioid and opioid-effective solubilizing agent from the surface, rinsing twice, each time with a volume of pure water equal to the original volume. After that time, analysis will show that at least 90% of the opioid present has been removed from the surface.

Example 6. (Decontaminate a surface using opioid-effective solubilizing agent and opioid-active reagent in separate steps; opioid-active reagent first) To a quantity of opioid on a surface, add a volume of the opioid-active reagent in water equal to 100 times the volume of the opioid. The concentration of the opioid-active reagent in water should be selected to contain a weight of the opioid-active reagent at least 10 times the weight of the opioid. Allow 1 hour of contact between the opioid-active reagent mixture and the opioid, with mechanical stirring or mixing to encourage contact. Then add a volume of the opioid-effective solubilizing agent in water equal to 100 times the volume of the opioid. The concentration of the opioid-effective solubilizing agent in water should be selected to contain a weight of the opioid-effective solubilizing agent at least 5 times the weight of the opioid. Allow 1 hour of contact between the opioid-effective solubilizing agent mixture and the opioid, with mechanical stirring or mixing to encourage contact. After that time remove the mixture of opioid and opioid-effective solubilizing agent from the surface, rinsing twice, each time with a volume of pure water equal to the original volume. After that time, analysis will show that at least 90% of the opioid present has been removed from the surface.

Although the present invention has been described in considerable detail with reference to certain preferred versions thereof, other versions are possible. Therefore, the spirit and scope of the appended claims should not be limited to the description of the preferred versions contained herein.

The reader's attention is directed to all references which are filed concurrently with this specification and which are incorporated herein by reference.

All the features in this specification (including any accompanying claims, abstract, and drawings) may be replaced by alternative features serving the same, equivalent or similar purpose, unless expressly stated otherwise. Thus, unless expressly stated otherwise, each feature disclosed in one example only of a generic series of equivalent of similar features. Any element in a claim that does not explicitly state "means for" performing a specified function, or "step for" performing a specific function, is not to be interpreted as a "means" or "step" clause as specified in 35 U.S.C. § 112 ¶6 or 35 U.S.C. § 112(f).

What is claimed is:

1. A composition for decontaminating opioids, the composition comprising an opioid-active reagent and an opioid-effective solubilizing agent, wherein the opioid-effective solubilizing agent is a mixture of an alkyl dimethylamine oxide surfactant, an alkyl dimethylamine oxide surfactant, a $C_{8-18}$ alkyl polyethylene glycol sorbitan fatty ester surfactant, and a $C_{12-14}$ secondary alcohol ethoxylate surfactant.

2. A method of decontaminating opioids, the method comprising the step of applying the composition of claim 1 to a surface or an object contaminated with an opioid; and, using the composition of claim 1 to chemically convert the opioid into an opioid reaction product.

3. The method of claim 2 further comprising the step of providing mechanical energy to the composition of claim 1 in contact with the opioid to enhance mixing between the composition and the opioid.

4. The method of claim 3, wherein the mechanical energy is either stirring, spraying, power washing, brushing, ultrasonic energy, or combinations thereof.

5. The method of claim 2, wherein the composition of claim 1 further comprises an opioid-effective solubilizing agent.

6. The method of claim 5, wherein the opioid-active reagent has a chemical reactivity such that the opioid-active reagent converts a fentanyl into an opioid reaction product.

7. The method of claim 6, wherein the opioid-active reagent is selected from the group consisting of chlorine dioxide, a peroxide, an organic peroxide, a peracetic acid, trichloroisocyanuric acid and sodium dichloroisocyanurate.

8. The method of claim 7, wherein the opioid-active reagent is chlorine dioxide.

9. The method of claim 7, wherein the composition further comprises a chlorine dioxide precursor.

10. The method of claim 9, wherein the chlorine dioxide precursor is sodium chlorite.

11. The method of claim 10, wherein the composition further comprises an acid that promotes conversion of sodium chlorite to chlorine dioxide.

12. The method of claim 10, wherein the composition further comprises an organic photoactivator to promote conversion of sodium chlorite to chlorine dioxide;

and the method further comprising the steps of exposing the composition to light and photogenerating chlorine dioxide.

* * * * *